US008707480B2

(12) United States Patent
Graddy

(10) Patent No.: US 8,707,480 B2
(45) Date of Patent: Apr. 29, 2014

(54) MULTILAYER, PAGING, MODULAR BED BLANKET SYSTEM

(76) Inventor: Robert F. Graddy, Imperial Beach, CA (US)

( * ) Notice: Subject to any disclaimer, the term of this patent is extended or adjusted under 35 U.S.C. 154(b) by 181 days.

(21) Appl. No.: 13/364,287

(22) Filed: Feb. 1, 2012

(65) Prior Publication Data

US 2013/0191991 A1 Aug. 1, 2013

(51) Int. Cl.
*A47G 9/02* (2006.01)

(52) U.S. Cl.
USPC ..... 5/486; 5/482; 5/494; 5/495; 5/496; 5/498; 5/499; 5/500; 5/501; 5/502

(58) Field of Classification Search
USPC ..... 5/482, 486, 494, 495, 496, 498, 5/499–502
See application file for complete search history.

(56) References Cited

U.S. PATENT DOCUMENTS

| | | | | |
|---|---|---|---|---|
| 3,331,088 | A | 7/1967 | Marquette | |
| 3,508,284 | A | 4/1970 | Marquette | |
| 3,508,285 | A | 4/1970 | Marquette | |
| 3,530,516 | A | 9/1970 | Marquette | |
| 3,584,323 | A | 6/1971 | Worley | |
| 4,005,499 | A | 2/1977 | Klein | |
| 4,069,526 | A * | 1/1978 | Deikel | 5/486 |
| 4,573,227 | A | 3/1986 | Prandina | |
| 4,903,361 | A | 2/1990 | Tang | |
| 5,146,634 | A | 9/1992 | Hunt | |
| 5,664,269 | A | 9/1997 | Broder | |
| 5,887,299 | A | 3/1999 | Phillips | |
| 6,311,347 | B1 | 11/2001 | Limardi et al. | |
| 6,698,043 | B2 | 3/2004 | Fabian | |
| 6,862,760 | B2 | 3/2005 | Bradley et al. | |
| 7,100,223 | B1 | 9/2006 | Anthony | |
| 2007/0226905 | A1 * | 10/2007 | VanNeste | 5/486 |
| 2008/0289105 | A1 * | 11/2008 | Ranzau | 5/482 |
| 2008/0313809 | A1 * | 12/2008 | Inman, II | 5/486 |
| 2011/0252563 | A1 * | 10/2011 | Horstman | 5/486 |
| 2011/0289686 | A1 * | 12/2011 | Chose | 5/497 |
| 2012/0060283 | A1 * | 3/2012 | Campasano | 5/495 |
| 2012/0167305 | A1 * | 7/2012 | Davis et al. | 5/486 |
| 2012/0233777 | A1 * | 9/2012 | Hare | 5/498 |
| 2012/0246828 | A1 * | 10/2012 | Argento | 5/486 |
| 2013/0055501 | A1 * | 3/2013 | Lisboa | 5/494 |

* cited by examiner

*Primary Examiner* — William Kelleher
(74) *Attorney, Agent, or Firm* — George S. Levy

(57) ABSTRACT

This invention is a modular blanket system for double beds essentially built like a ring binder where the rings, called straps, are made of a flexible material and are closed by means of detachable fasteners such as hook-and-loop, snaps or buttons. The use of straps as a binding means allows blanket leaves to be added, subtracted or paged from one side to the other depending on the sleepers' need for warmth or decorative taste.

16 Claims, 5 Drawing Sheets

MULTILAYER, PAGING, MODULAR BED BLANKET SYSTEM

FIELD OF THE INVENTION

This invention relates to blankets, more particularly multilayer blankets for double beds and equipped with a centrally located hinge and hinged leaves that can be paged or turned from one side of the double bed to the other side.

BACKGROUND

People who sleep in the same bed often have different thermal needs. Conventional blankets, however, can only provide a uniform degree of thermal protection. A blanket may be adequate for one of the sleepers but too hot or too cold for the other. The blanket may even be unsatisfactory for both sleepers.

The prior art does include multilayer blankets comprising leaves attached to a centrally located hinge. However the nature and construction of the hinge greatly limits the flexibility and convenience of these blankets. For example, U.S. Pat. No. 4,069,526, by Deikel describes a blanket system comprising a full-size base layer covering the double bed and two half-size leaves which are hinged to the base layer by means of two zippers running along the center of the base layer. This design can only accommodate two leaves because of the limitations inherent in the zipper hinge mechanism. Furthermore, each leaf needs to carry a zipper side complementary to the zipper side mounted in the base layer. In addition, leaves can only be mounted in a particular orientation because each side of the attaching zipper must operate in the same direction. These restrictions limit the number of layer combinations. In addition, the hardness of the zipper can detract from the softness of the blanket.

In U.S. Pat. No. 5,664,269, by Broder, the hinge mechanism is implemented by having each leaf comprised of two layers, each one of these layers being attached at the hinge to an adjacent layer in a daisy chain fashion. This construction provides a very limited number of combinations.

The approach taken by Marquette in U.S. Pat. No. 3,508,285, makes use of hook-and-loop fasteners at the hinge. Marquette's approach limits the number of panels to the number of hook-and-loop strips.

U.S. Pat. No. 6,311,347, Limardi et al makes use of buttons to attach two half blankets. This approach is limiting in the number of layers that can be attached. Furthermore, overlapping such leaves creates regions of double thickness.

Further features, aspects, and advantages of the present invention over the prior art will be more fully understood when considered with respect to the following detailed description and claims.

SUMMARY OF THE INVENTION

This invention is a modular blanket system for double beds essentially built like a ring binder where the rings, called straps (or loops) are made of fabric or a functionally equivalent material. They can be opened or closed thereby allowing blanket leaves to be added, subtracted or paged from one side to the other depending on the sleepers' need for warmth. Straps can be closed by means of detachable fasteners such as hook-and-loop fasteners, buttons, snaps and the like. The blanket system comprises a base blanket with a spine configured to hold the fabric straps and running down its center from the head to the foot of the bed. The straps are equipped at their ends with detachable and manually operable fasteners. The blanket system also comprises a number of blanket leaves, each leaf covering essentially half of the bed on either side of the spine and hinged to the spine by means of the straps.

The spine can be built in a number of ways. For example it could comprise a fabric band sewn in parts to, and detached in parts from, the base blanket thereby allowing the straps to be inserted between the base blanket and the fabric band. For example, the band could be equipped with parallel pairs of slots longitudinally directed from the head to the foot of the bed, each strap being inserted and looping through each pair of slots.

Alternatively, the straps can be mounted along the spine, on top of and attached to the base blanket. In yet another variation, no reinforcing band is used. Instead, the base blanket itself is traversed with slots through which the straps can loop.

Straps can be closed by means of hook-and-loop fasteners, buttons or any convenient attachment method.

Leaves are selected with varying thermal insulation and any element of the multilayer blanket system can be decorated, including the base, the leaves, the spine, and the straps. Leaves can include, along their edges, fasteners adapted to attach each leaf to other adjacent leaves.

To adjust the warmth of the blanket system or to select new decorations the following actions are taken: the straps are opened, a new leaf is inserted or an inserted leaf is removed. The straps are closed. The leaves can then be paged to satisfy the users' need for warmth or taste for decorations.

This blanket system has several advantages over the prior art:

1. Large number of leaves. The number of leaves is not limited by the configuration of the base blanket or of the spine.
2. Unrestricted combination of leaves. Leaves can be selected as the sleeper desires to be heavy or light fabric or of any style or color.
3. Unrestricted orientation of the leaves. The spine mechanism does not, like the prior art, make use of zippers which are restricted by their orientation and polarity. More specifically, zippers must have a starting location and an ending location which defines their orientation. Zippers must also have a polarity since each side of a zipper must be different for them to mesh properly. Each side of a zipper mounted on the base blanket can only accommodate a single blanket leaf. This invention is not restricted by such considerations.
4. Flat bedspread. Fabric straps allow the blanket sections to be easily paged and to lay flat on the bed after they are turned. In contrast, hook-and-loop attachments used in prior art results in leaves having to be folded over themselves, which results in double thickness along the spine.

Unlike prior art, the invention's hinge mechanism requires minimal effort, minimal dexterity, and it inherently provides accurate alignment of the leaves with the base layer and with each other.

DETAILED DESCRIPTION

Figure 1:
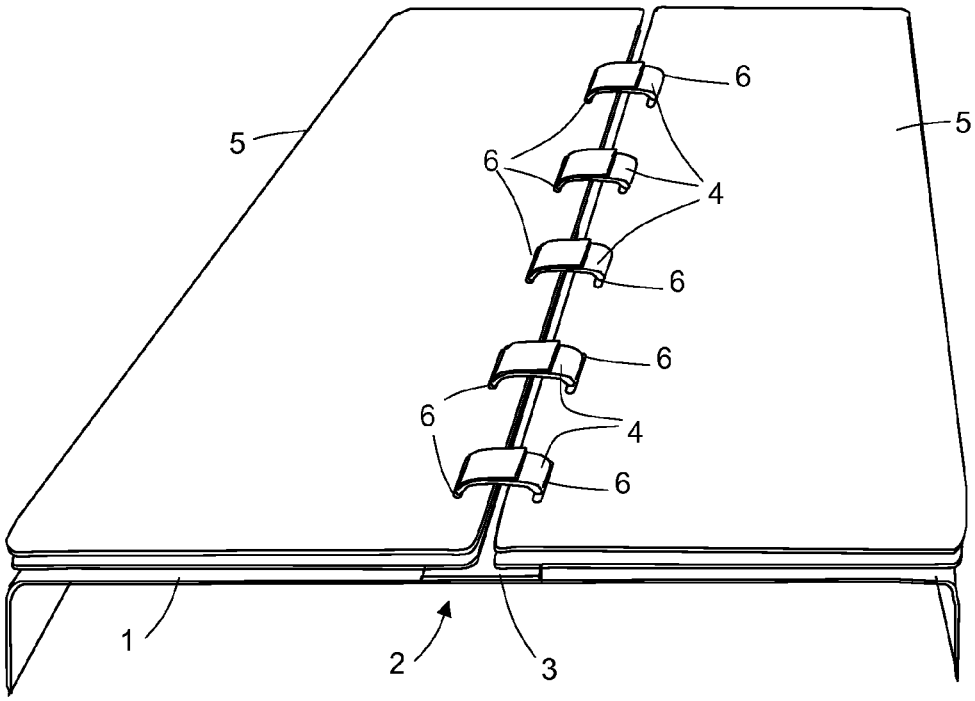
FIG. 1 shows the invention in perspective including the base blanket, the spine, the straps and the leaves.
Figure 2:
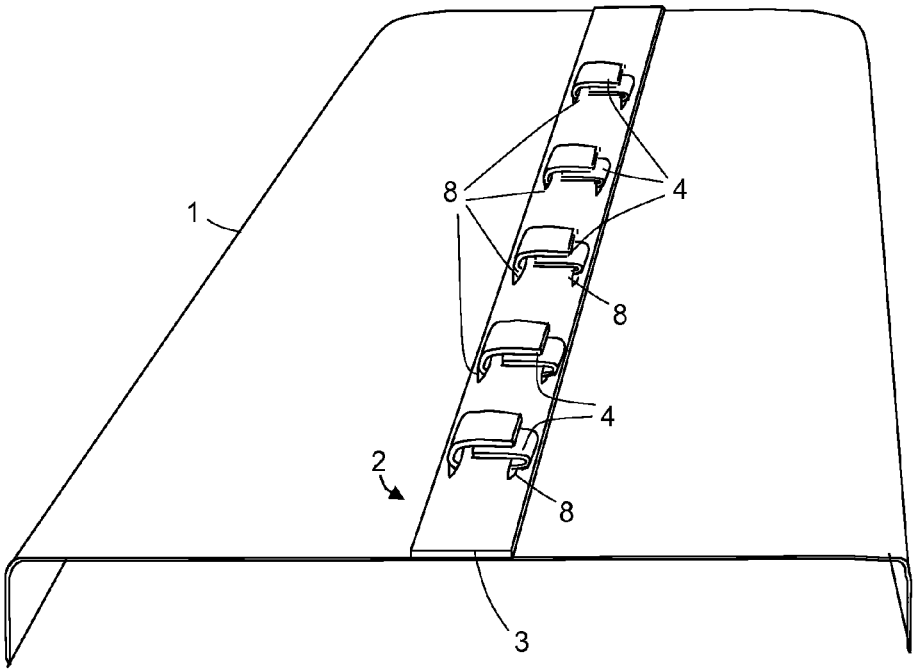
FIG. 2 shows only the base blanket with straps and a reinforced spine wherein the spine comprises a reinforcing band with pairs of parallel slots oriented in the longitudinal direction of the bed, that is in the head to foot direction FIG. 2A provides a cross-sectional view of the spine and the straps, wherein the spine has a reinforcing band with pairs of slots.
Figure 2A:
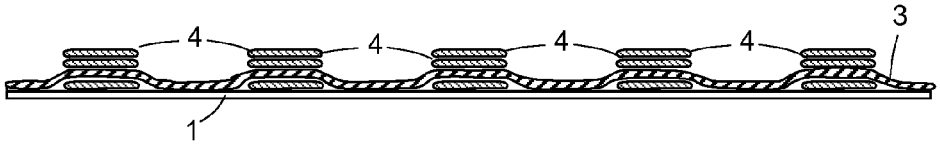

As shown in FIG. 1 the invention comprises the following elements:

A base sheet or base blanket 1 shown in FIGS. 2 and 2A. This base blanket covers the whole double bed and includes a spine 2 going down the middle from the head to the foot of the bed. The spine 2 comprises a band 3 of fabric sewn to the base blanket 1. The band 3 has pairs of parallel slots 8 placed at regular intervals. The slots 8 are cut in the longitudinal direction, that is, from the head to the foot of the bed. A detailed view of the band forming the spine is provided in FIG. 2 as a perspective view and in FIG. 2A as a cross-sectional side view.

Figure 3:
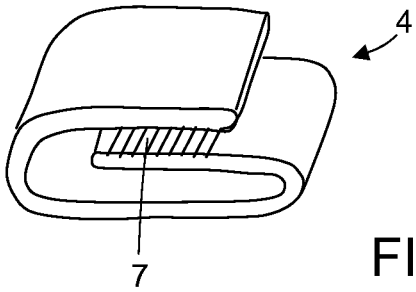
FIG. 3 illustrates a strap made of fabric with a hook-and-loop attachment mechanism.

The invention also comprises straps (or loops) 4 made of fabric or a functionally equivalent material shown in detail in FIG. 3 that can be opened or closed by means of fasteners such as hook-and-loop 7, buttons, snaps or the like. These straps 4 are configured to slide through the slots 8 under the band 3.

As shown in FIG. 1, the invention also comprises blanket sections or leaves 5 approximately half the size of the base blanket 1. These leaves 5 are perforated along one of their long edges with slots 6 that are sized and shaped to allow the fabric straps 4 to pass through.

The invention is assembled as a ring binder notebook, by "binding" the leaves 5 to the spine 2 of the base blanket 1 by means of the fabric straps 4. Sleepers using the blanket system can choose how many leaves 5 cover them and whether the leaves are heavy (for warmth) or light.

Figure 3A:
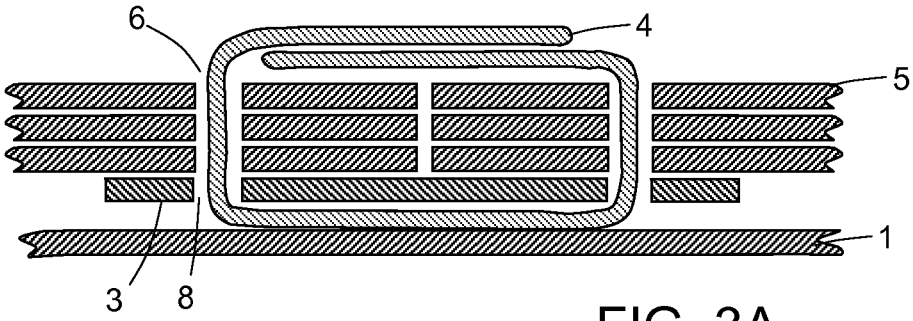
FIG. 3A shows a cross-sectional view of a strap with an equal number of leaves on either side.
Figure 3B:
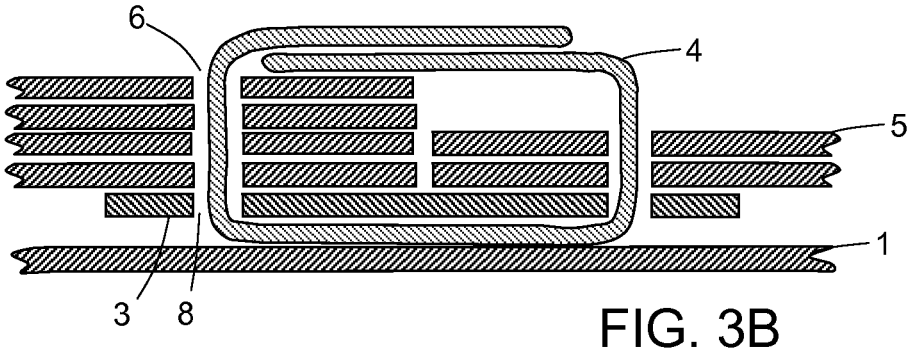
FIG. 3B shows a cross-sectional view of a strap with an unequal number of leaves on either side.

If two people sleep together in the double bed and they are both cold, they can add more leaves 5 by opening the straps 4, inserting the leaves 5 and closing the straps 4. Similarly, if both sleepers are hot, they can remove leaves 5. As shown in FIG. 3A and FIG. 3B, if one of the sleepers is cold and the other sleeper is hot, they can page the leaves 5 from the hot sleeper to the cold one.

Figure 4:
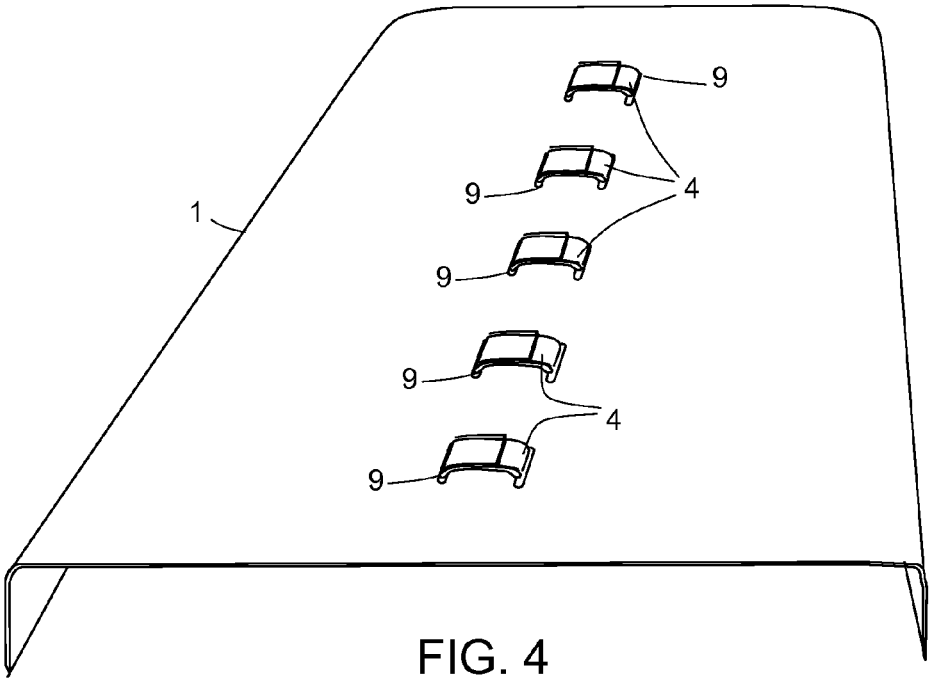
FIG. 4 shows a base blanket in which the spine does not have a reinforcing band. The straps traverse the base blanket through pairs of parallel slots cut in the blanket.
Figure 4A:
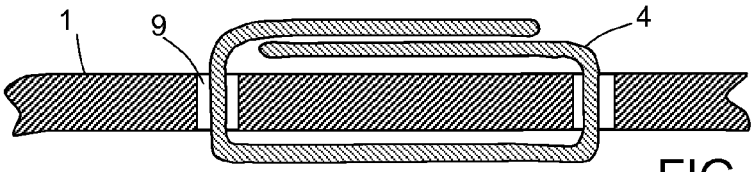
FIG. 4A provides a cross-sectional view perpendicular to the spine, wherein the spine does not have a reinforcing band.
Figure 4B:
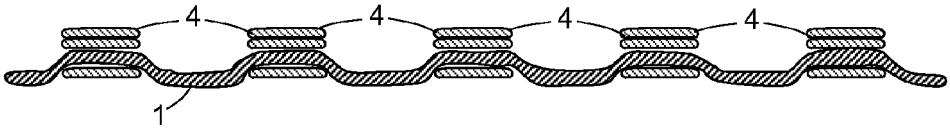
FIG. 4B provides a cross-sectional view parallel to the spine, wherein the spine does not have a reinforcing band.

A possible variation on this basic design is to dispense with the band 3 and simply configure slots 9 directly in the base blanket 1 as shown in FIG. 4. A cross-sectional view of this configuration, along the long axis of the bed is provided by FIG. 4A. A cross sectional view along the axis of the spine is shown in FIG. 4B.

Figure 5:
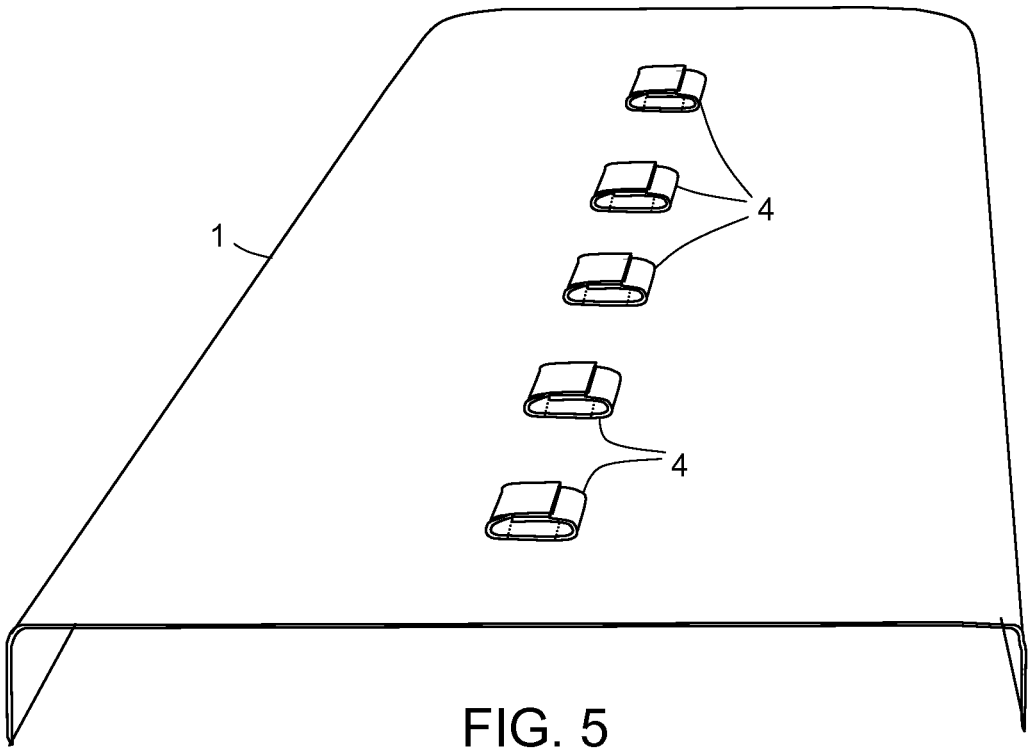
FIG. 5 shows a base blanket in which the straps are attached, for example sewn, directly to the top of the base blanket.
Figure 5A:
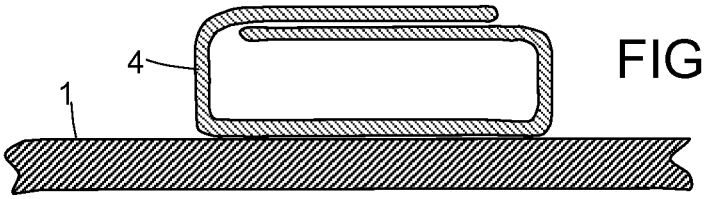
FIG. 5A provides a cross-sectional view perpendicular to the spine, wherein the straps are attached directly to the top of the base blanket.
Figure 5B:
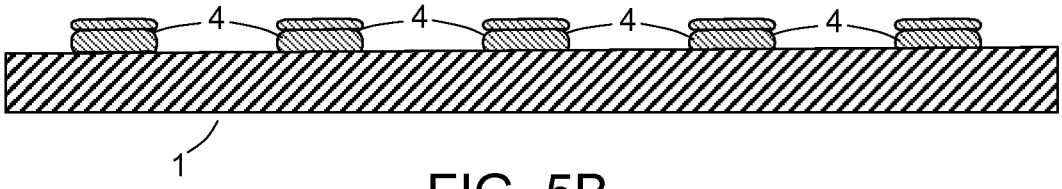
FIG. 5B provides a cross-sectional view parallel to the spine, wherein the straps are attached directly to the top of the base blanket.

Yet another variation is shown in FIGS. 5, 5A and 5B. It involves attaching (for example sewing) the straps directly to the base blanket 1.

Other variations include:

1. Base blankets and leaves can be of the same fabric type and fabric weight.
2. Different fabrics and/or weights can be used for the left side and right side of the base blanket.
3. Leaves can be made with differing fabrics and/or weights.
4. Base blanket, band, leaves and straps can display any combination of pattern or color.
5. Leaves can be used independently, without a base blanket, individually or in layers.
6. The number of connecting straps can vary.
7. Fasteners can include buttons, hooks, snaps, hook-and-loop (Velcro™), zippers, etc.
8. Leaves can be built with or without reinforced trim panels.
9. The edges of the leaves can be configured with fasteners to hold them down.

While the above description contains many specifics, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A multilayer blanket system for a double bed having a head and a foot comprising:

a) a base blanket configured with a spine running down the center of said base blanket from said head to said foot;

b) said spine configured to hold fabric straps, each said fabric strap closed by means of a detachable fastener configured such that said straps can be manually opened;

c) a plurality of blanket leaves, each said blanket leaf of a size adapted to cover essentially half of said base blanket on either side of said spine, each said blanket leaf having a hinged edge, each said blanket leaf also equipped along said hinged edge with a number of slots configured to allow said fabric straps through; and d) said blanket leaves being joined to said base blanket and to each other by said fabric straps.

2. The multilayer blanket system of claim 1 wherein said spine comprises a fabric band sewn in parts to, and detached in parts from, said base blanket thereby allowing said straps to be inserted between said base blanket and said fabric band.

3. The multilayer blanket system of claim 1 wherein said spine comprises a fabric band equipped with parallel pairs of slots longitudinally directed from said head to said foot, each said strap being inserted and looping through each said pair of slots.

4. The multilayer blanket system of claim 1 wherein said base blanket is equipped with parallel pairs of slots longitudinally directed from said head to said foot, each said strap being inserted and looping through each said pair of slots.

5. The multilayer blanket system of claim 1 wherein said straps are mounted along said spine, on top of and attached to said base blanket.

6. The multilayer blanket system of claim 1 wherein said base blanket includes along said spine a number of slot pairs adapted to allow said straps to slide through and fasten said leaves to said base blanket.

7. The multilayer blanket system of claim 1 wherein each said strap includes a hook-and-loop fastener.

8. The multilayer blanket system of claim 1 wherein each said strap includes a button fastener.

9. The multilayer blanket system of claim 1 wherein said leaves are selected with varying thermal insulation characteristics.

10. The multilayer blanket system of claim 1 wherein each said leaf has an edge and includes along said edge, fasteners adapted to be fastened to other said leaves.

11. The multilayer blanket system of claim 1 wherein said leaves are selected with varying decorations.

12. The multilayer blanket system of claim 1 wherein said straps are selected with varying decorations.

13. The multilayer blanket system of claim 1 wherein said spine is selected with varying decorations.

14. The multilayer blanket system of claim 1 wherein said base blanket is selected with varying decorations.

15. A method using the blanket system of claim 1, of adjusting a warmth of said blanket system or displaying decorations of said blanket system comprising:

a) adjusting the number of said blanket leaves, dubbed joined blanket leaves, joined to said blanket system by:

i. opening said straps;

ii. inserting a new leaf, said new leaf becoming one of said joined blanket leaves;

iii. closing said straps; and iv. paging said joined blanket leaves until said blanket warmth or decorations becomes satisfactory.

16. A method using the blanket system of claim 1, of adjusting a warmth of said blanket system or displaying decorations of said blanket system comprising:

a) adjusting the number of said blanket leaves, dubbed joined blanket leaves, joined to said blanket system by:

i. opening said straps;

ii. removing one of said joined blanket leaves, removed said joined blanket leaf ceasing to be one of said joined blanket leaves;

iii. closing said straps; and iv. paging said joined blanket leaves until said blanket warmth or decorations becomes satisfactory.

* * * * *